US005109752A

United States Patent [19]

Yu

[11] Patent Number: 5,109,752

[45] Date of Patent: May 5, 1992

[54] UNIVERSAL SELF-TIMING AMMUNITION LOADER

[75] Inventor: Dino Yu, Corona, Calif.

[73] Assignee: Western Design Corp., Irvine, Calif.

[21] Appl. No.: 632,531

[22] Filed: Dec. 24, 1990

[51] Int. Cl.[5] ..... F41A 9/30

[52] U.S. Cl. ..... 89/33.17; 89/33.16

[58] Field of Search ..... 89/33.01, 33.02, 33.16, 89/33.17, 33.25, 34

[56] References Cited

U.S. PATENT DOCUMENTS 2,993,415 7/1961 Panicci et al. ..... 89/33.02
3,618,454 11/1971 Christenson ..... 89/34
3,704,772 12/1972 Meier ..... 89/33.01
4,123,962 11/1978 Williams ..... 89/33.03
4,708,049 11/1987 Durant et al. ..... 89/33.17

*Primary Examiner*—Stephen Johnson
*Attorney, Agent, or Firm*—Walter A. Hackler

[57] ABSTRACT

A self-timing ammunition interface system is provided which includes an exit unit for accepting and delivering ammunition rounds and a linker/delinker for inserting ammunition rounds into the exit unit and receiving downloaded ammunition rounds from the exit unit. Lobed rotors are provided for automatically aligning the engagement of an exit unit interfere gear and a loader interface drive gear disposed in the linker/-delinker.

14 Claims, 6 Drawing Sheets

UNIVERSAL SELF-TIMING AMMUNITION LOADER

The present invention is generally related to ammunition feeding and handling systems for automatic weapons and, more particularly, directed to apparatus for loading and down-loading ammunition which is also operable for delinking ammunition rounds as they are fed into a linkless ammunition storage system and linking ammunition rounds as they are down-loaded from a linkless ammunition storage system.

Many weapon systems include non-removable ammunition magazines that require reloading with live ammunition rounds to replace live ammunition. Such ammunition magazines and feeding apparatus are typically linkless systems in order to significantly reduce the volume and weight thereof. Such linkless systems include ammunition handling apparatus which enables the conveying of separate ammunition rounds without ammunition links for supporting the ammunition rounds in a spaced-apart relationship.

While the linkless ammunition magazine and feeding apparatus is more space efficient than linked ammunition systems in the handling of ammunition rounds in a weapon, bulk storage of ammunition is more conveniently provided through the use of linked ammunition rounds. Consequently, apparatus has been developed for transferring such bulk stored linked ammunition into a linkless ammunition magazine and storage system. In general, this equipment includes an exit unit for receiving and delivering linkless ammunition rounds to and from the linkless ammunition magazine and feed system and a linker/delinker unit designed for engaging the exit unit and transferring linkless ammunition at spaced-apart intervals from a linked ammunition source and conversely receiving linkless ammunition in a spaced-apart manner and linking such down-loaded ammunition for purpose of bulk storage thereof.

Typical of such apparatus is one manufactured by General Electric under Model No. 5194107 and a General Electric linker/delinker loader Model No. 5191200. While operation of these units has been successful, a problem arises in the capability of the linker/delinker to be quickly attached to the exit unit. As can be expected, in many instances, reloading of ammunition magazines must be done in an expeditious manner during combat conditions.

While decoupling of the linker/delinker from the exit unit normally poses no problem, coupling of the two units requires an alignment of interface gears therein in order to properly time the linker/delinker unit with the exit unit, so that during the delinking phase the ammunition rounds can be delivered in an exact spaced-apart and positioned relationship for acceptance and handling by the exit unit for subsequent delivery to the ammunition magazine. Similarly, when ammunition is down-loaded, ammunition must be delivered in a precise timely manner so it can be inserted into links which are mechanically interconnected with finite spacing therebetween.

Unfortunately, the configuration of existing exit units and cooperating delinker units includes thirty-six tooth gears mounted for rotation on a common shaft with sprockets having five pockets thereon for accepting and delivering ammunition rounds. This non-integral number of teeth per pocket (7.2) results in a configuration in which the gears can only be correctly timed once every revolution thereof in order for a proper alignment of the sprockets between the linker/delinker unit and the exit unit. This results in a situation where, before coupling the linker/delinker unit with the exit unit, the gears must be aligned in a once-in-a-revolution position in order to properly align the sprockets for proper timed passing of ammunition from a linker/delinker unit to and from the exit unit.

The prior art linker/delinker units are coupled to the prior art exit units by means of a pin about which the linker/delinker unit is rotated for engagement of interface gears between the exit unit and the linker/delinker unit. During such rotation, visual contact with the mating gears must be made just before such mating in order to properly align and time the teeth thereon. Unfortunately, this can be a tedious procedure during combat situations and misalignment of the interface gears, such that the sprockets are not appropriately timed, can result in jamming of the system which requires uncoupling of the linker/delinker unit from the exit unit removal of jammed ammunition and a recoupling of the units with one another, hopefully in a properly timed manner. Needless to say, serious consequences can occur if there is some damage caused by misfeeding of the ammunition between the linker/delinker unit and the exit unit.

Hence, a self-timing ammunition interface system which provides for automatic alignment of the interface gears and transfer sprockets upon rotational closing movement between the linker/delinker unit and the exit unit would be a welcome improvement in existing systems. In addition, in view of the substantial number of ammunition systems in the field, it would be most beneficial if a modification could be made to such exit units so they could alternatively be coupled to a new self-timing linker/delinker unit or a conventional prior art linker/delinker unit. Such is the subject matter of the present invention.

SUMMARY OF THE INVENTION

A self-timing ammunition interface system in accordance with the present invention generally includes exit unit means for accepting and delivering ammunition rounds at spaced-apart intervals, with the exit unit means including a housing adapted for coupling with linker/delinker means and exit unit interface drive gear means for timing the movement of the ammunition rounds. A linker/delinker is provided for inserting ammunition rounds, delivered by the exit unit, into interconnected ammunition links and removing ammunition rounds from the ammunition links and delivering said ammunition rounds at spaced-apart intervals to the exit unit. The linker/delinker includes a housing adapted for coupling with the exit unit and a loader interface drive gear for timing the inserting and removal of ammunition rounds from the ammunition links. The loader interface drive gear and the exit unit face drive gear are configured and disposed for engagement with one another when the exit unit and the linker/delinker are coupled to one another.

Cooperating means, having portions disposed in each of the exit unit and the linker/delinker are provided for automatically aligning the engagement of the exit unit interface drive gear and the loader interface drive gear to one of several rotational orientations as the exit unit interface drive gear and the loader interface drive gear are pushed into engagement during coupling of the exit unit with the linker/delinker unit. Each of the several rotational orientations hereinabove noted enable timed acceptance and delivery of ammunition to and from the exit unit means and the linker/delinker unit. This is a significant improvement over prior art in that the timing of the exit unit interface drive gear and the loader interface drive gear is automatic and a plurality of orientations of the exit unit interface drive gear and the loader interface drive gear result in proper timing whereas in the prior art only one rotational position in 360 degrees provides for such proper ammunition timing.

More particularly, the cooperating means may comprise a pair of lobed rotors, one each disposed in the exit unit and the linker/delinker unit and, respectively, interconnected with the exit unit interface drive gear and the linker/delinker interface drive gear for rotation therewith.

Second lobed rotors may be provided with one each disposed in the exit unit and the linker/delinker unit, adjacent the hereinabove mentioned lobed rotors. The adjacent lobed rotors are coaxially mounted for rotation with the exit unit interface drive gear and the linker/-delinker interface drive gear, respectively. Two lobed rotors may be coaxially mounted with an orientation, relative to one another, so that projecting portions of one of the adjacent lobed rotors is generally aligned with recessed portions of another adjacent lobed rotor. An identical relationship between the lobed rotors coaxially mounted with the linker/delinker interface drive gear may also be established.

In addition, the exit unit may include a pocket sprocket for accepting and delivering of ammunition rounds with the pocket and sprocket being interconnected with the exit unit interface drive gear and timed thereby. Further, the exit unit interface drive gear may include a number of teeth equal to an interval number of the number of pockets on the pocket and sprocket means and each lobed rotor includes a number of lobes equal to the number of pockets on the pocket and sprocket.

More particularly, the number of pockets on the pocket and sprocket means may equal five and the number of teeth on the exit unit interface drive gear may equal thirty.

In addition, to provide universal coupling between the apparatus of the present invention and prior art exit units, second interface drive gear may be provided and disposed for engagement with a conventional linker/-delinker interface drive gear when such a conventional linker/delinker is coupled to the exit unit of the present invention.

BRIEF DESCRIPTION OF THE DRAWINGS

The present invention can be more readily understood by a consideration of the following detailed description when taken in conjunction with the accompanying drawings, in which.

DETAILED DESCRIPTION

Figure 1:
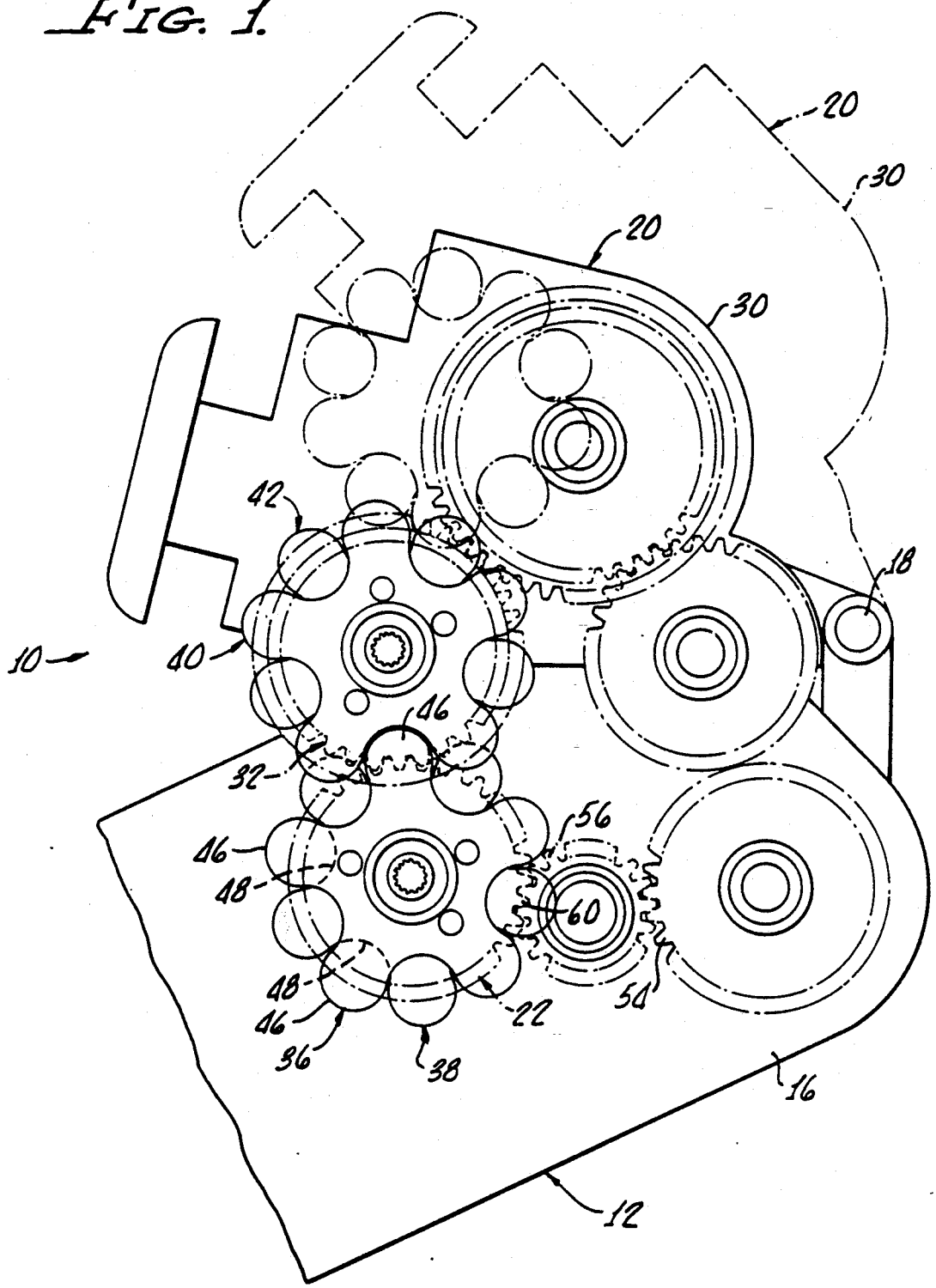
FIG. 1 is a side elevation of a self-timing ammunition interface system in accordance with the present invention, including an exit unit and a linker/delinker shown in an open position, broken line, and closed position, solid line.
Figure 2:
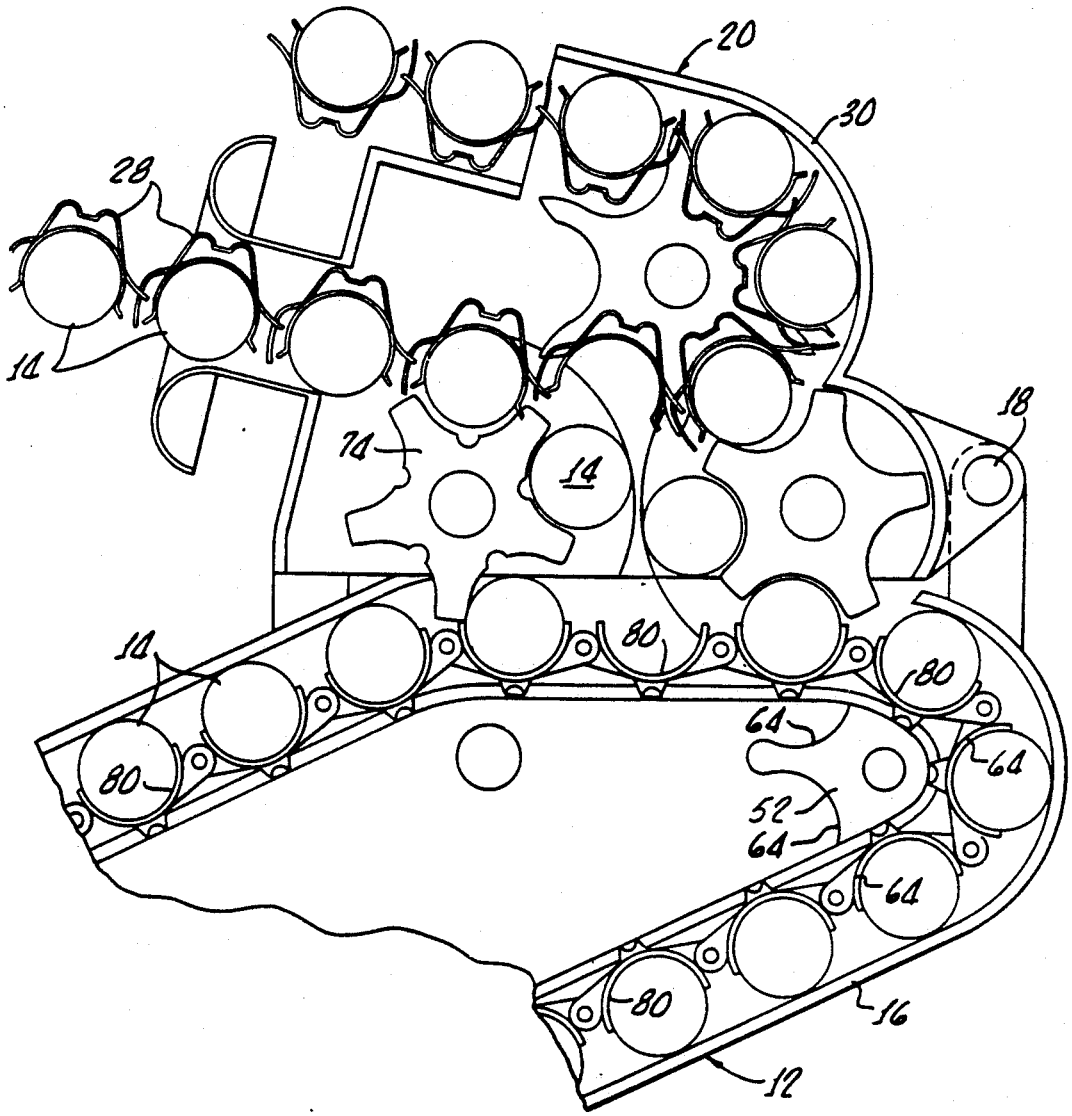
FIG. 2 is a cross-sectional view showing the mechanism behind the apparatus shown in FIG. 1.

Turning now to FIG. 1, there is shown a self-timing ammunition interface system 10 generally including an exit unit 12 which provides means for accepting and delivering ammunition rounds 14, see FIG. 2, at spaced-apart intervals, which includes a housing 16 which is adapted for coupling through a pin 18 with a linker/-delinker 20 shown in an open position (broken line) and a closed position (solid line) in FIG. 1. An exit unit interface drive gear 22 provides means for timing the accepting and delivering of ammunition rounds.

The linker/delinker 20 provides means for inserting ammunition rounds 14, delivered by the exit unit 12, into interconnected ammunition links 28 and removing ammunition rounds 14 from the ammunition links 28 and delivering the ammunition rounds 14 at spaced about intervals to the exit unit 12. The linker/delinker includes a housing 30 adapted for coupling with the exit unit 12 through the removable pin 18 and a loader interface drive gear 32 for timing the insertion and removal of ammunition rounds 14 from the ammunition links 28.

The linker/delinker 20, which includes the housing 30 and general gear arrangement, and the exit unit 12, which includes the housing 16 and general gear arrangement, are essentially identical with General Electric Company loader Model 5191200 and General Electric Company exit unit Model 5194107, respectively. Since the overall arrangement and configuration of the linker/delinker 20 and exit unit 12 are well known in the art, reference should be made to the hereinabove referenced General Electric units for the overall construction features.

The present invention is directed to an improvement, or modification, of the gear type and additional members, to be hereinafter discussed in greater detail, for improving the operation of the General Electric units.

The hereinabove referred to members include cooperating lobed rotors 36, 38 disposed in the exit unit 12 lobed rotors 40, 42 disposed in the linker/delinker 20 which together provide means for automatically aligning the engagement of the exit unit interface drive gear 22 and the loader interface drive gear 32 as the exit unit interface drive gear 22 and the loader interface drive gear 32 are pushed into engagement during coupling of the exit unit 12 with the linker/delinker 20. A feature of this arrangement is that a plurality of rotational orientations are available which enable the timed acceptance and delivery of ammunition to and from the exit unit 12 and the linker/delinker 20.

While only one lobed rotor 36 disposed in the exit unit 12 and one lobed rotor 40 disposed in the delinker 20 may be utilized to cause self-timing of the exit unit drive gear 20 and the linker/delinker drive gear 32, it is preferable that two such lobed rotors be utilized to enable the hereinabove recited timing. The lobed rotors 36, 38, 40, 42, and operation thereof, to be discussed in greater detail hereinafter, are new and provide a substantial improvement for the operation of the General Electric loader and exit unit.

It can be seen from FIG. 1 that the lobed rotors 36, 38 are coaxially mounted for rotation with the exit unit interface drive gear 22 and the lobed rotors 40, 42 are coaxially mounted for rotation with the linker/delinker interface drive gear 32.

The lobed rotors are oriented with one another, so that projecting portions 46 of a lobed rotor 36, are generally aligned with recessed portions 48 of an adjacent lobed rotor 38. As also shown in FIG. 1, the lobed rotors 36, 38, 40, 42 preferably include five lobes and the lobed rotors 36, 38, coaxially mounted with the exit unit interface drive gear 22 are angularly displaced from one another by 31 degrees. In addition, the two lobed rotors 40, 42 are coaxially mounted with the linker/-delinker interface gear 32 and are angularly displaced from one another by 31 degrees.

As with the General Electric units, the exit means 12 includes a pocketed sprocket 52 interconnected by means of a series of cluster gears 54, 56, with the pocketed sprocket providing means for accepting and delivering ammunition rounds and timed, through the cluster gears 54, 56, with the exit unit drive gear 22.

Importantly, the exit unit interface drive gear 22 includes a number of teeth 60 equal to an integral multiple of the number of pockets 64, sprocket 52. This is unlike the prior art General Electric device. The existing General Electric device utilizes thirty-six tooth gears and five pockets 64 on the sprocket 52. This non-integer number of teeth to sprocket ratio (7.2) results in a situation where the gears can only be correctly timed once every revolution. Unfortunately, this yields a situation where four out of five locations on each gear are theoretically out of time when a rotor pocket 64 is aligned.

The present invention eliminates this gear to rotor pocket timing problem by changing the thirty-six tooth gear of the General Electric exit unit to thirty tooth, 60, gear 22, utilizing the same pitch time and the same center distance as the thirty-six tooth gear. This results in an integer number of teeth to pocket ratio (6) hence, by changing to thirty tooth gear 22, each General Electric unit can be timed every 72 degrees or one-fifth of a revolution.

Figure 3:
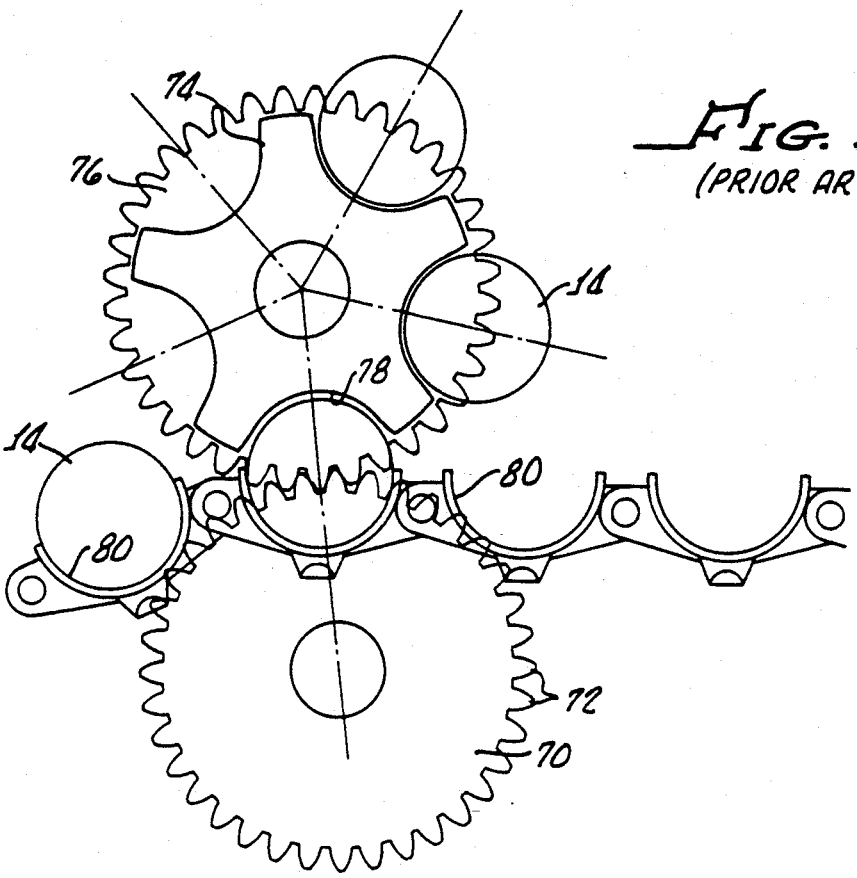
FIG. 3. (PRIOR ART)
FIG. 3 shows the gear arrangement in prior art devices which enable gears and buckets to align only once every 360 degrees.

An illustration of the General Electric unit is presented in FIG. 3 in which the prior art exit unit drive gear 70, having teeth 72, drives a sprocket 74 through a sprocket gear 76, also having thirty-six teeth, resulting in alignment of the sprocket pocket 78 with the gear 70 and ammunition transporting buckets 80 only once per revolution of the drive gear 70 and sprocket 74.

Figure 4:
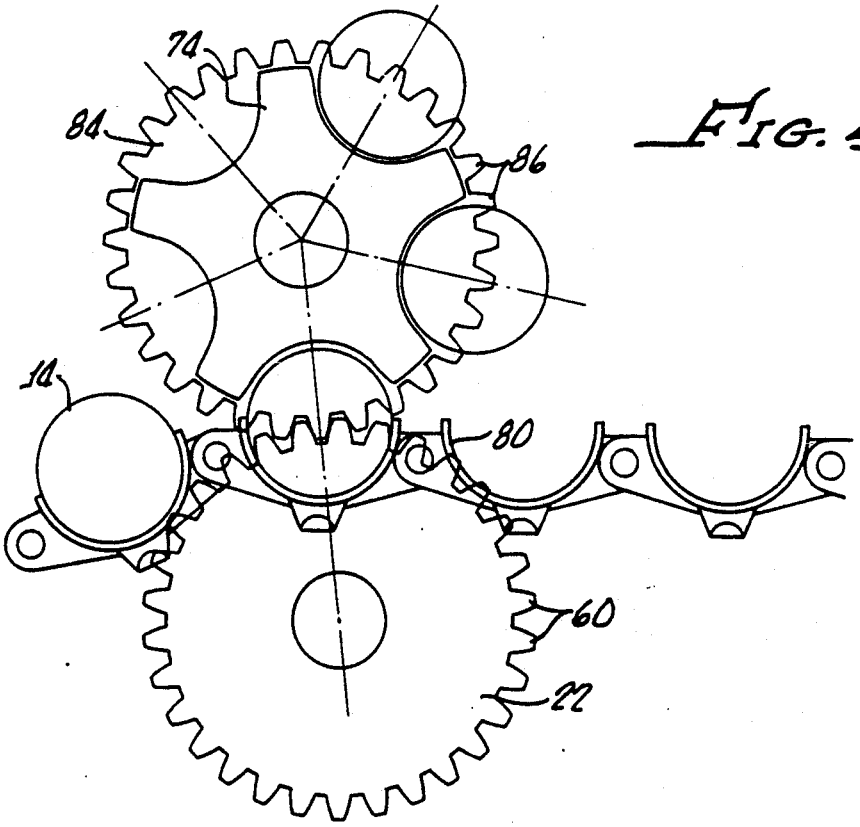
FIG. 4 is an arrangement of the present invention which enables the gears and buckets to align every 72 degrees.

This should be compared with the arrangement in accordance with the present invention shown in FIG. 4 in which the exit unit drive gear 22 having thirty teeth engages a sprocket gear 84, also having thirty teeth 86 for aligning the sprocket 52 with the exit unit drive gear 22 and buckets 80 every 72 degrees.

An important feature of the present invention is that the modified self-timing ammunition interface system 10 according to the present invention is still useful for use with conventional General Electric type linker/-delinker units.

Figure 5:
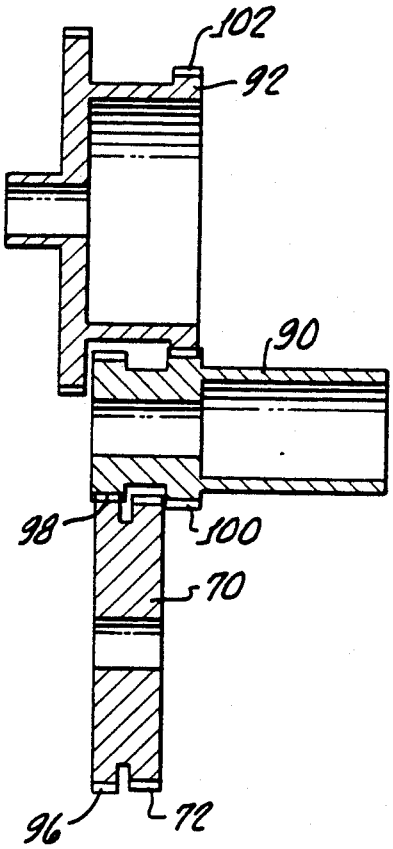
FIG. 5. (PRIOR ART)
FIG. 5 is a diagram of the gear configuration of prior art exit unit.

In turning to FIG. 5, there is illustrated diagrammatically the General Electric prior art exit unit gear layout consisting of the interface gear 70 along with cluster gears 70, 90, 92. Engagement of the interface gear 70 with linker/delinker (not shown) is by means of teeth 72 additional teeth 96 engage teeth 98 on a cluster gear 90 which is timed with gear 92 via teeth 100, 102, respectively. As hereinabove pointed out, the number of teeth 72 on the prior art interface drive gear 70 is thirty-six.

Figure 6:
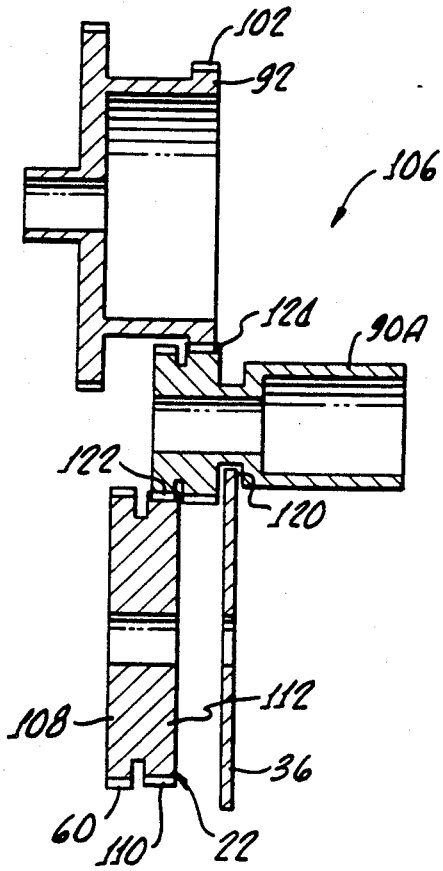
FIG. 6 is a gear configuration of the exit unit in accordance with the present invention.
Figure 7:
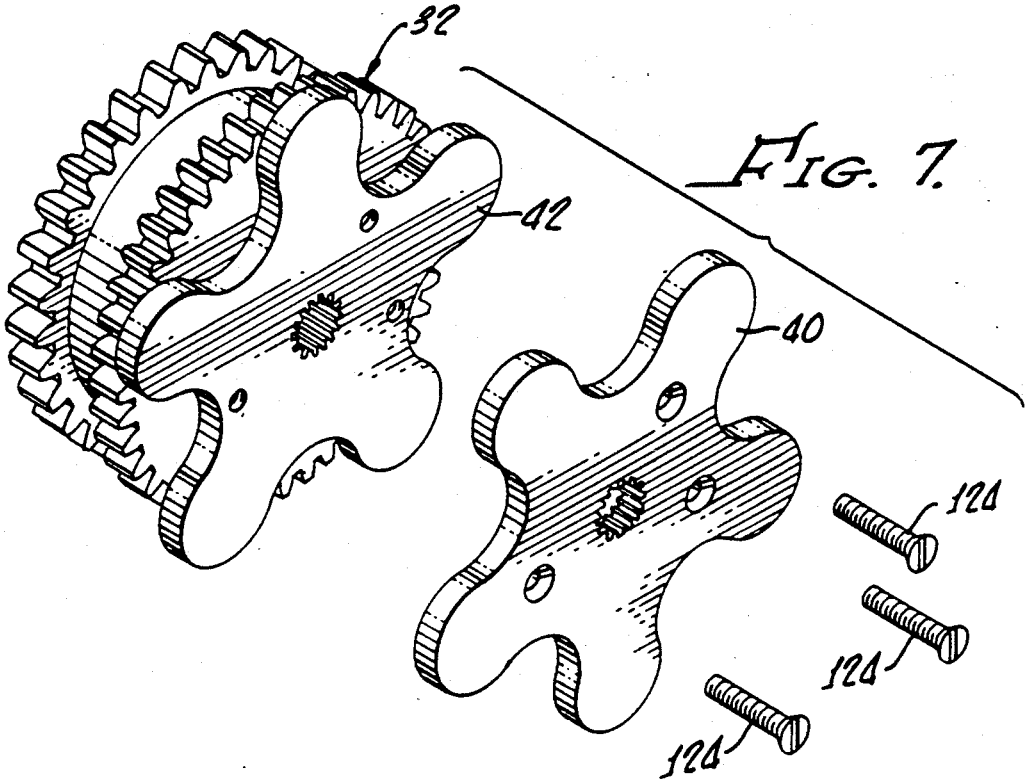
FIG. 7 is a perspective view of the gear and lobed rotor arrangement for the linker/delinker in accordance with the present invention.

As shown in FIG. 6, a replacement gear train 106 includes the same General Electric cluster gear 92, but a new gear 90A and the exit unit drive gear 22 of the present invention along with the lobed rotor 36. Thirty teeth 60 are disposed on a left side 108 of the drive gear 22 while thirty-six gear teeth 110 are disposed on a right side 112 of the gear 22. As compared with the prior art device shown in FIG. 5, the teeth 110 are positioned such that a conventional General Electric linker/-delinker would engage the gear teeth 110 of the present invention in a conventional manner.

As shown in FIG. 6 the cluster gear, the cutaway portion 120, in order to enable free rotation of the lobed rotor 36, the lobed rotor 38, not being shown in FIG. 6. The new cluster gear 90A includes teeth 122 for engaging with the teeth 110 of the drive gear 22 and teeth 124 for engaging with the gear 92 which remains identical to the prior art device. This arrangement enables the exit unit of the present invention to be utilized with the linker/delinker 20 of the present invention or a conventional General Electric prior art linker/delinker.

Correspondingly, the drive gear in the conventional General Electric linker/delinker (not shown) is replaced with drive gear 32 and lobed rotors 40, 42 added pins 124 or the like are provided for mounting the lobed rotors 40, 42 to the drive gear 32 in the orientation hereinabove set forth.

Figure 8:
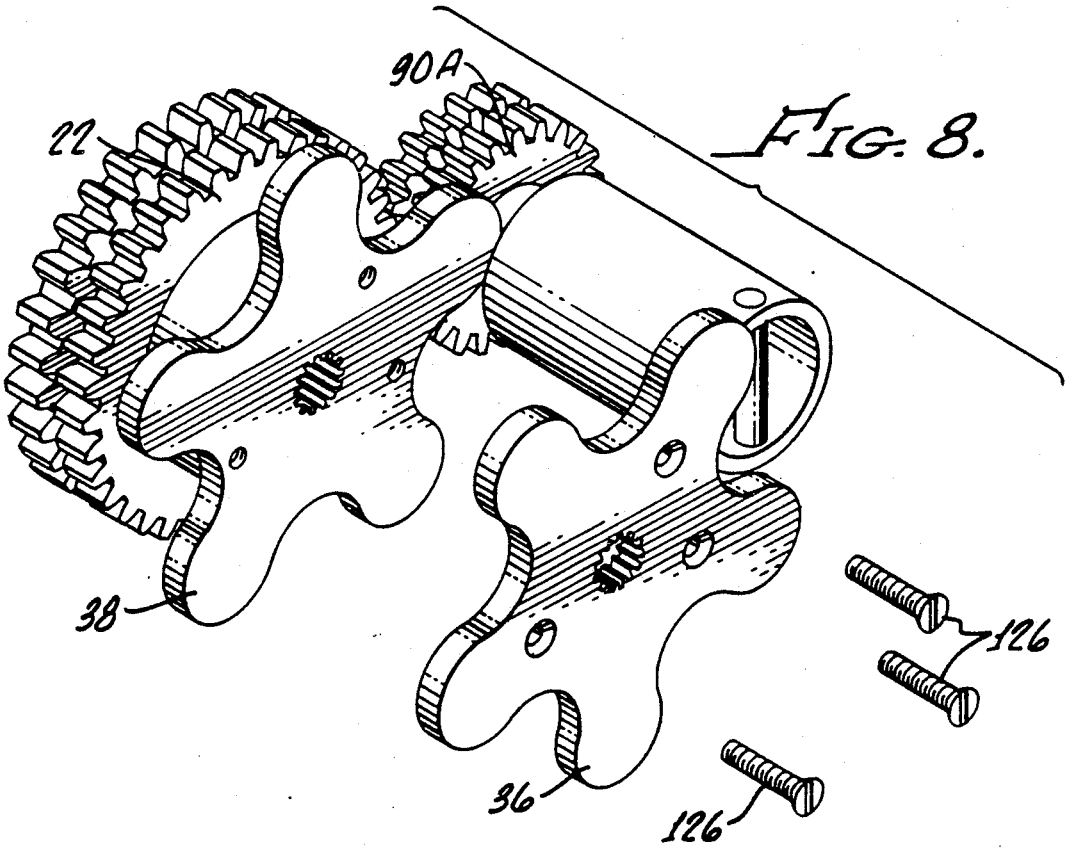
FIG. 8 is a perspective view of the gear and lobed rotor arrangement for the exit unit in accordance with the present invention.

FIG. 8 shows the corresponding exit unit drive gear 22 along with the cluster gear 90A and the lobed rotors 36, 38 with corresponding mounting pins 126.

In operation, the linker/delinker 20 is pivotally attached to the exit unit 12 by means of the pin 18, see FIG. 1, and thereafter rotated from an open position, shown in broken line in FIG. 1, to a closed position with the interface gears 22, 32 properly engaged by means of the lobed rotors 36, 38, 40, 42, shown in solid line in FIG. 1.

Figure 9:
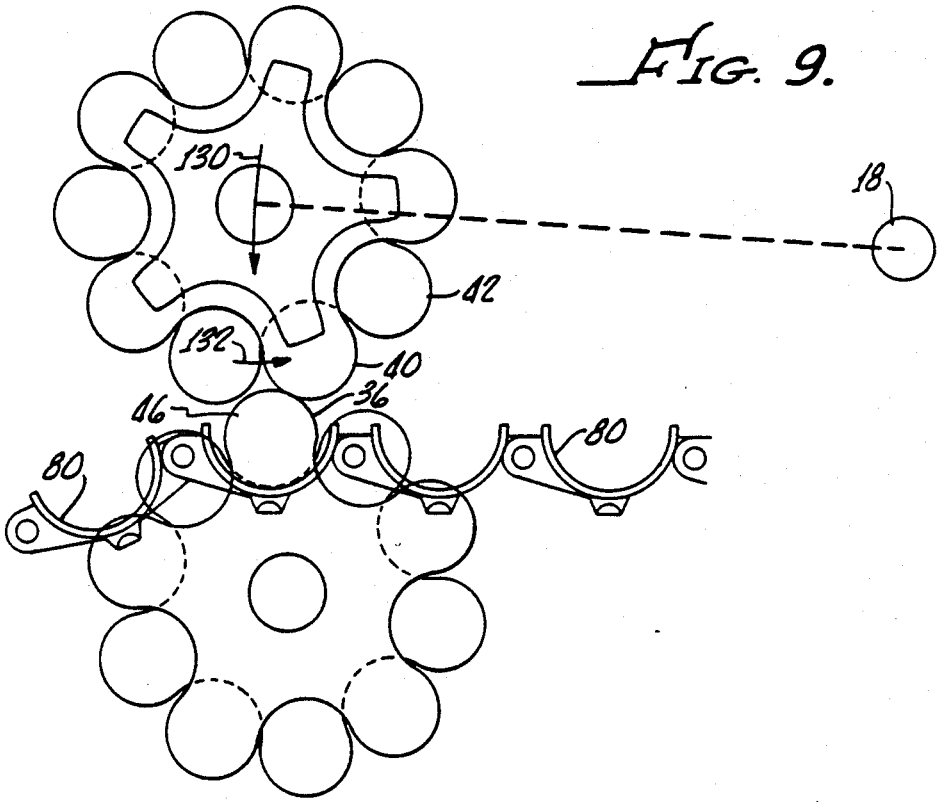
FIG. 9 is a diagram illustrating how lobed rotors of the present invention rotate in order to align the gears and buckets.
Figure 10:
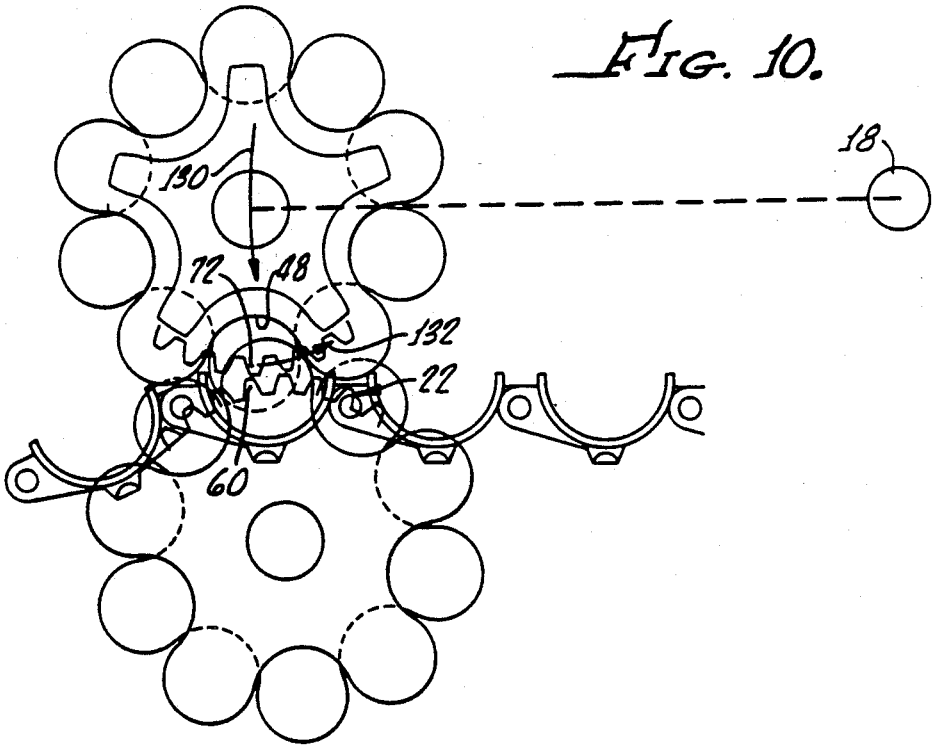
FIG. 10 shows an aligned configuration as a result of the rotation shown initially in FIG. 9.

The operation of the lobed rotors 36, 38, 40, 42 is diagrammatically shown in FIGS. 9 and 10 in which FIG. 9 corresponds to the broken line, a position of the linker/delinker 20, shown in FIG. 1, and FIG. 2 corresponds to the closed position of the linker/delinker as shown by the solid line in FIG. 1.

As shown in FIG. 9, as the linker/delinker is rotated about the pin in the direction of the arrow 130, the lobe 40 engages a lob 36 thereby causing rotation of the lobed rotors 40, 42 in the direction of arrow 132 so that the lobe 46 goes into the recess 48 as shown in FIG. 10. This alignment enables the teeth 60 on the gear 22 to align with the teeth 72 on the linker/delinker drive gear 32. No matter what the initial orientation of the linker/-delinker 32 is with respect to the exit unit drive gear 22 as they approach each other by pivotal movement around pin 18, the lobed rotors 36, 38, 40, 42 cooperate to rotate and align the linker/delinker drive gear 22 teeth 72 with the teeth 60 of the exit drive gear 22.

Although there has been described hereinabove a specific arrangement of a self-timing ammunition interface system in accordance with the present invention for the purpose of illustrating the manner in which the invention can be used to advantage, it is to be appreciated that the invention is not limited thereto. Accordingly, any and all variations and modifications which may occur to those skilled in the art are to be considered to be within the scope of the spirit of the invention as defined in the appended claims.

What is claimed is:

1. A self-timing ammunition interface system comprising:

exit unit means for accepting and delivering ammunition rounds at spaced apart intervals, said exit unit means comprising a housing adapted for coupling with linker/delinker means and exit unit interface drive gear means for timing the accepting and delivering of said ammunition rounds;

said linker/delinker means for inserting said ammunition rounds, delivered by said exit unit means, into interconnected ammunition links and for removing said ammunition rounds from the ammunition links and delivering said ammunition rounds at spaced apart intervals to the exit unit means, said linker/-delinker means comprising a housing adapted for coupling with said exit unit means and loader interface drive gear means for timing the insertion and removal of said ammunition rounds from said ammunition links, said loader interface drive gear means and exit unit interface drive gear means being configured and disposed for engagement with one another when said exit unit means and linker/delinker means are coupled to one another; and cooperating means, having portions disposed in each of the exit unit means and linker/delinker means, for automatically aligning the engagement of the exit unit interface drive gear means and the loader interface drive gear means to one of several rotational orientations as the exit unit interface drive gear means and loader interface drive gear means are pushed into engagement driving coupling of the exit unit means and linker/delinker means, each of said several rotational orientations enabling timed acceptance and delivery of ammunition to and from the exit unit means and linker/delinker means, said cooperating means comprising a set of lobed rotors, two each disposed in said exit unit means and linker/delinker means, respectively, with two lobed rotors of said set of lobed rotors coaxially mounted for rotation with the exit unit interface drive gear means and two lobed rotors of said set of lobed rotors coaxially mounted for rotation with the linker/delinker interface drive gear means, the two lobed rotors coaxially mounted with the exit unit interface drive gear means being oriented with one another to that projecting portions of one of said last mentioned lobed rotors are generally aligned with recessed portions of another of said last mentioned lobed rotors, and the two lobed rotors coaxially mounted with the linker/-delinker interface drive gear means being oriented with one another so that projecting portions of one of said last mentioned lobed rotors are generally aligned with recessed portions of another of said last mentioned lobed rotors.

2. The self-timing ammunition interface system according to claim 1 wherein each said lobed rotor includes 5 lobes and the two lobed rotors coaxially mounted with the exit unit interface drive gear means are angularly displaced from one another by 31 degrees and the two lobed rotors coaxially mounted with the linker/delinker interface drive gear means are angularly displaced from one another by 31 degrees.

3. The self-timing ammunition interface system according to claim 1 wherein said exit unit means further comprises pocketed sprocket means for accepting and delivering of ammunition rounds, said pocketed sprocket means being interconnected with said exit means interface drive means and timed thereby.

4. The self-timing ammunition interface system according to claim 3 wherein said exit unit interface drive gear means comprises a number of teeth equal to an integral multiple of a number of pockets on said pocketed sprocket means.

5. The self-timing ammunition interface system according to claim 4 wherein each said lobed rotor includes a number of lobes equal to the number of pockets on said pocketed sprocket means.

6. The self-timing ammunition interface system according to claim 5 wherein the number of pockets on said pocketed sprocket means equals 5 and the number of teeth on said exit unit interface drive gear means equals 30.

7. The self-timing ammunition interface system according to claim 6 wherein said lobed rotors each include means for defining a 5-leaf clover shape with symmetrical outside and inside radii.

8. The self-timing ammunition interface system according to claim 1 wherein said exit means further comprises pocketed sprocket means for accepting and delivering of said ammunition rounds, said pocketed sprocket means being interconnected with said exit means interface drive means and timed thereby.

9. The self-timing ammunition interface system according to claim 8 wherein said exit unit interface drive gear means comprises a number of teeth equal to an integral multiple of a number of pockets on said pocketed sprocket means.

10. The self-timing ammunition interface according to claim 9 wherein each said lobed rotor includes a number of lobes equal to the number of pockets on said pocketed sprocket means.

11. The self-timing ammunition interface system according to claim 10 wherein the number of pockets on said pocketed sprocket means equals 5 and the number of teeth on said exit unit interface drive gear means equals 30.

12. The self-timing ammunition interface system according to claim 11 wherein said exit unit means further comprises second interface drive gear means for engagement with a 36 tooth linker/delinker interface drive gear when the 36 tooth interface drive gear linker/delinker is coupled to said exit unit means.

13. The self-timing ammunition interface system according to claim 12 wherein said lobed rotors each include means for defining a 5-leaf clover shape with symmetrical outside and inside radii.

14. A self-timing ammunition interface system comprising:

exit unit means, comprising a pocketed sprocket, for accepting and delivering ammunition rounds at spaced apart intervals and communicating with a transfer system for conveyance of ammunition rounds to and from an ammunition magazine, said pocketed sprocket being interconnected for rotation with an interface cluster gear having a number of teeth equal to an integral multiple of a number of pockets on said pocketed sprocket, said exit means further comprising first lobed timing rotor, interconnected for rotation with said pocketed sprocket and said interface cluster gear, said exit unit lobed timing rotor having a number of lobes equal to the number of pockets of said pocketed sprocket, the first lobed timing rotor, in combination with a second lobed timing rotor, aligning said interface cluster gear with a mating loader interface drive gear at positions causing the pocketed sprocket to be synchronous with the spaced apart ammunition rounds;

linker/delinker means for inserting ammunition rounds, provided at spaced apart intervals, into interconnected ammunition links and removing ammunition rounds from ammunition links and delivering said ammunition rounds at spaced apart intervals, said linker/delinker means being adapted for coupling and uncoupling with said exit unit means, said linker/delinker means including said mating loader interface drive gear adapted and positioned for engagement with the exit unit interface cluster gear when the linker/delinker means is coupled to the exit unit means, and the second lobed timing rotor which is interconnected for rotation with said mating loader interface drive gear and having a number of lobes equal to the number of lobes on said first lobed timing rotor.

* * * * *